United States Patent [19]

Richards

[11] 4,101,130

[45] Jul. 18, 1978

[54] GOLF MAT

[76] Inventor: Earl Richards, 310 N. Lake Ave., Leesburg, Fla. 32748

[21] Appl. No.: 757,965

[22] Filed: Jan. 10, 1977

[51] Int. Cl.[2] ..... A63B 69/36

[52] U.S. Cl. ..... 273/187 A; 35/29 A

[58] Field of Search ..... 273/187 R, 187 A, 187 B, 273/183 A, 195 R, 32 A, 195 A, 195 B; 35/29 A

[56] References Cited

U.S. PATENT DOCUMENTS

| | | | |
|---|---|---|---|
| 2,707,638 | 5/1955 | Manley | 273/187 A |
| 2,777,697 | 1/1957 | Crossot | 273/187 R |
| 3,658,344 | 4/1972 | Kimble | 273/187 R |
| 4,000,905 | 1/1977 | Shirhall | 273/187 A |

*Primary Examiner*—George J. Marlo

*Attorney, Agent, or Firm*—Hauke and Patalidis

[57] ABSTRACT

A pliable mat for use by golfers for improving their stance and swing. The mat has a generally rectangular shape, is provided with cut-out portions delineating the position of the right and left feet of the golfer and has appropriately located indicia of length and golf club types for correctly locating the golf ball in position and distance from the golfer as a function of the club being used.

7 Claims, 5 Drawing Figures

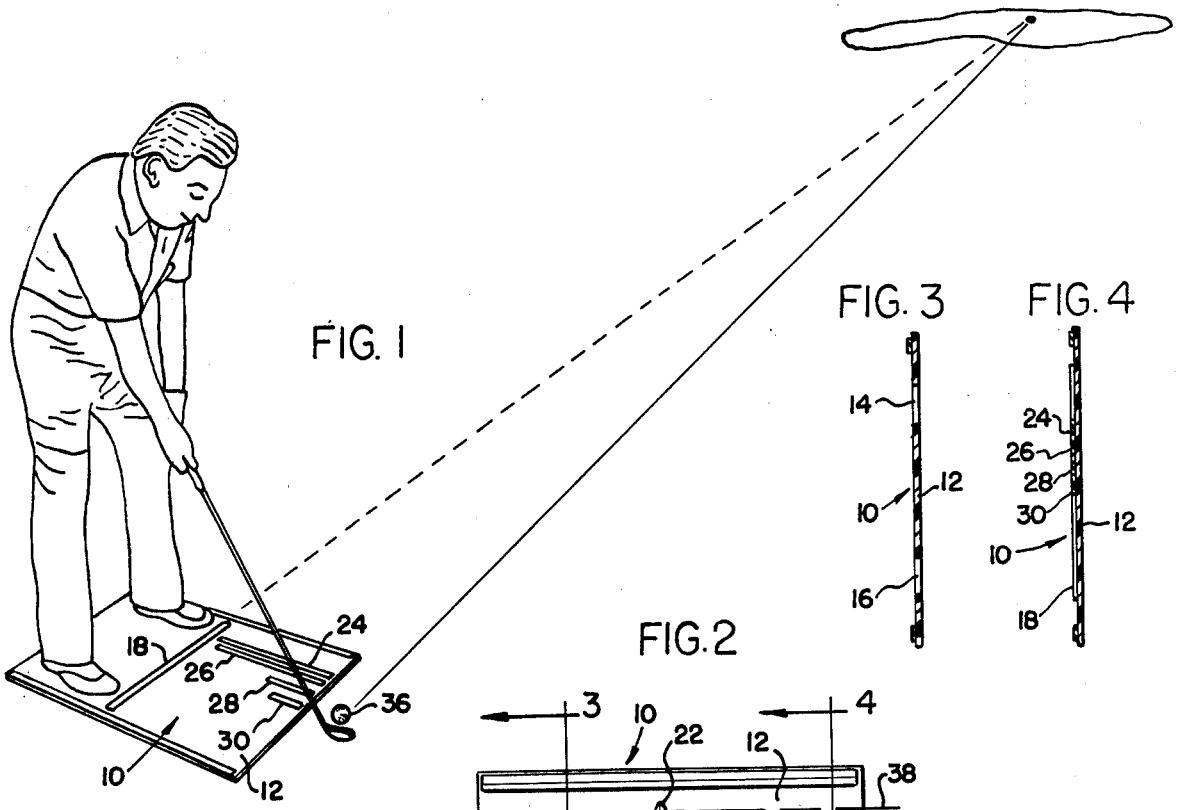
FIG. 1
FIG. 3
FIG. 4
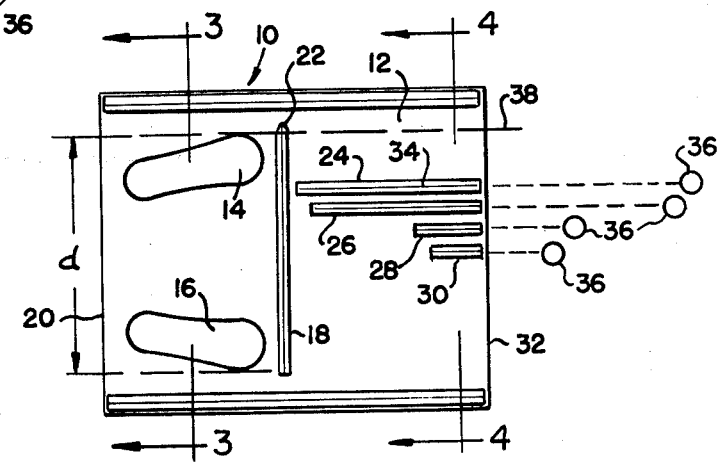
FIG. 2
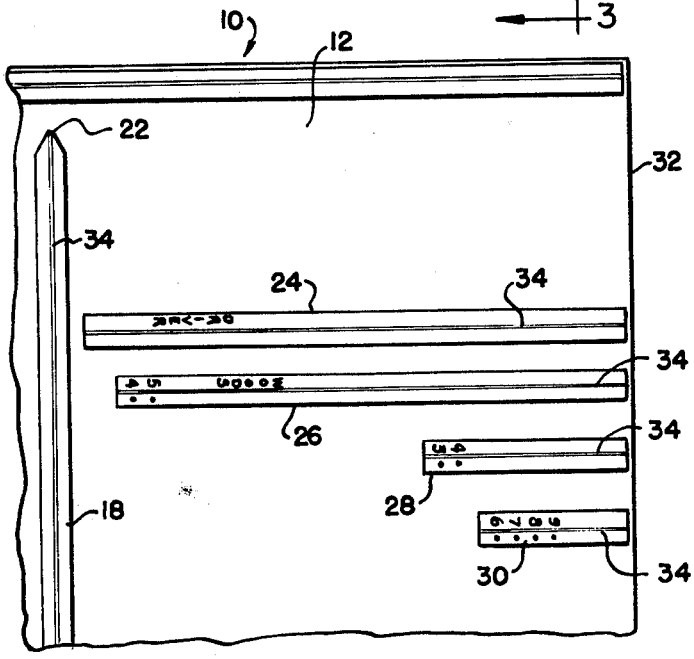
FIG. 5

GOLF MAT

BACKGROUND OF THE INVENTION

The present invention is a golf mat with appropriate designations for the placement of a golfer's feet relative to ball positioning and the golf club being used. It is a device for aiding a golfer in driving a golf ball along a straight predetermined path.

Golf swing indicating devices providing feet and ball positionings are known in the art. However, they are generally either too complicated for practical use, or too cumbersome to be carried around on a golf course, or so simplified that they take the form of a useless gadget incapable of providing a golfer with accurate guidelines for repetitive performance.

The present invention provides a simple device, useful to a novice as well as to an experienced golfer, which is economical to manufacture and readily portable by a single person walking long distances, and which establishes the correct position in which a particular golfer's feet should be placed to insure a proper stance, and the position in which a golf ball should be placed in relation to the stance in oder to insure an accurate shot in direction and reach.

SUMMARY OF THE INVENTION

The present invention accomplishes its objects and purposes by way of providing a mat made of pliable material having appropriate cut-out portions for placement of the feet of a golfer in a correct stance, the soles of the golfer's shoes resting directly on the ground, and by having inscribed or otherwise marked on the mat itself appropriately located indicia of length for correct positioning of the ball relative to the stance position, as a function of the golf club being chosen by the golfer.

BRIEF DESCRIPTION OF THE DRAWING

The many objects and advantages of the invention will become apparent to those skilled in the art when the following description of the best mode contemplated for practicing the invention is read in conjunction with the accompanying drawing wherein:

FIG. 1 is a perspective view of a golf mat according to the present invention, shown in use by a golfer.

FIG. 2 is a top plan view of the golf mat of the invention useful for explaining the manner in which it is used for proper ball positioning.

FIGS. 3 and 4 are sectional views thereof respectively along lines 3—3 and 4—4 of FIG. 2; and FIG. 5 is a partial plan view thereof, at an enlarged scale, to illustrate more fully the markings thereon.

DETAILED DESCRIPTION OF THE PREFERRED EMBODIMENT

Referring now to the drawing a golf mat 10, according to the present invention, consists of a substantially rectangular sheet 12 of pliable material such as canvas or the like, or pliable plastic or rubber-like material, preferably. The sheet 12 of material forming the mat 10 is relatively thin, in the order of ⅛ of an inch or less, and can be easily folded or rolled such that it can be carried by a golfer, under his arm or in his golf bag. The substantially rectangular sheet 12 of pliable material is provided, proximate an edge thereof with a pair of cut-out portions 14 and 16, in the general outline of the shoe soles corresponding to a left foot and a right foot, respectively. Proximate to the tip of the soles outline cutout portions 14 and 16, a strip of material is transversely disposed on the upper surface of the mat 10, as shown at 18, or alternatively, a marking corresponding to the strip 18, preferably of a color contrasting with the coloring of the mat surface, is disposed, as shown, parallel to the rear edge 20 of the mat 10. One end of the strip 18 is pointed, as shown at 22, to provide a graphic indication of the direction of flight of a golf ball 36 hit by a right-handed golfer, using the mat 10 placed on the ground as illustrated at FIG. 1, the strip 18 substantially defining the axis of swing of the club.

A plurality of strips of contrasting material are cemented or otherwise fastened to the surface of the mat 10, such strips being designated in the drawing by numerals 24, 26, 28 and 30. In the alternative, appropriate strip markings corresponding to the strips 24–30, may be embossed or otherwise arranged on the surface of the mat. The strips 24–30 are disposed between the transverse strip 18 and the edge 32 of the mat. Each strip 24–30 has a center line 34 clearly marked such as, for example, by means of a groove formed in the material of the strip. Each strip 24–30 is appropriately marked, as shown in detail at FIG. 5, with the type of club to be used, the ball being placed or, alternatively, the mat 10 being placed on the ground such that the ball 36 is located outside of the mat, as shown at FIG. 2, at a distance from the front edge 32 of the mat corresponding to the length of the strip or to a distance indicated on the strip, according to the club chosen for driving the ball.

When a driver is used, the ball 36 is aligned with the center line 34 of the strip 24 and is situated at a distance from the edge 32 of the mat 10 equal to the length of the strip 24. When using a #3 wood, the ball, aligned with the center line 34 of the strip 26, is located at a distance from the edge 32 of the mat equal to the length of the strip 26. A pair of dots, marked respectively "4" and "5", are marked on the strip 26. When using a #4 wood, the ball is located in alignment with the centerline 34 of the strip 26 at a distance from the edge 32 of the mat corresponding to the distance between the dot marked "4" and the edge 32 of the mat. When using a #5 wood, the ball is placed, aligned with the centerline 34 of the strip 26, at a distance from the edge 32 of the mat equal to the distance between the dot marked "5" on the strip 26 and the edge 32 of the mat. Similarly, when using a 190 3 or #4 iron, the ball is located, aligned with the centerline 34 of the strip 28, at a distance from the edge 32 of the mat corresponding to the distance between the dot marked "3" or the dot marked "4" and the edge 32 of the mat. When using a #2 iron, the distance of placement of the ball from the edge 32 of the mat is equal to the length of the strip 28, and the ball is aligned with the centerline 34 of the strip 28. Strip 30 is used to determine the placement of the ball, aligned with the centerline 34 of the strip 30, at a distance from the edge 32 of the mat corresponding to the length of the strip 30, when using a #5 iron, or to the distance between the edge 32 of the mat and the positions of the dots "6", "7", "8" and "9" when using a #6, #7, #8, or #9 iron.

Each golf mat 10 is made according to the physical characteristics of the person intending to use it. The shoe cut-out portions 14 and 16 are to the shoe size of the golfer, such that when addressing the ball and using the mat 10 of the invention, his feet actually rest on the ground. The stance angle is approximately 4° to the right for the right foot and 10° to the left for the left foot. The stance angle is appropriate for most shots, although some golfers prefer to adopt a more open stance for chip shots and putting. Other stance angles may evidently be used as desired by the golfer.

The distance separating the cut-out portions 14 and 16, or distance *d* as shown at FIG. 2, is equal to the shoulder width of the golfer. For example, if the shoulder width of the golfer is 18½ inches the distance *d* is also 18½ inches. If the height of the golfer is about 5 feet 7 inches, the centerline 34 of the driver strip 24 is 4 inches from a reference line 38, parallel to the strips 24–30 and drawn tangent to the outside contour of the left foot cut-out portion 14. The length of the strip 26 is about 13½ inches and the centerline 34 is located 5½ inches from the reference line 38. The dot for a #4 wood is located about 13 inches from the end of the strip 26 and the dot for the #5 wood is located about 12½ inches. The centerline 34 of the strip 28 is 7½ inches from the reference line 38, and its total length is 5½ inches. The dot for the #3 iron is 5 inches and the dot for the #4 iron is 4½ inches from the end of the strip 28.

The centerline 34 of the strip 30 is 9½ inches from the reference line 38, and its total length is 4 inches. The dots corresponding to the #6, #7, #8, and #9 irons are located respectively 3½, 3, 2½, and 2 inches from the end of the strip 30.

For proportionally taller or shorter golfers, the length of the strips 24 and 26 are proportionally shorter or longer, the length of the strips 28 and 30 remaining the same as previously indicated. Differences in golfer heights are also compensated for by locating the cut-out portions 14 and 16 closer or further away from the strip 18. Generally, for each inch of increase in height of the golfer, the strips 24 and 26 are decreased in length by ½ inch and vice versa.

The locations of the dot indicia remain at constant half inch distances from each other and from the reference end of the appropriate strip. It will be readily apparent that this example of relative dimensions is given for illustrative purpose only and that many variations of such dimensions may be accomodated by the present invention according to the personal preferences of the golfer or the directions of his instructor.

In order to facilitate the use by a golfer of a golf mat 10 according to the present invention, lengths of strings or, preferably, tape may be precut, using the length of the strips 24–30 and the dot markings on the strips 26–30 to determine how long such lengths of string or tape should be for use with each golf club type. The lengths of string or tape are appropriately identified as to the corresponding club type, and they are used as gauges by the golfer for accurate distance location of the ball relative to the edge 32 of the mat, in alignment with the centerline 34 of the appropriate strip.

It can thus be seen that by use of the mat of the present invention, the golfer is readily capable of improving his score by properly addressing the ball under all circumstances, with a result that his shots are constantly repetitive and dependable.

Having thus described the present invention by way of a typical example of structural embodiment thereof, modifications whereof will be readily apparent to those skilled in the art,

What is claimed as new is as follows:

1. A mat for use by a golfer comprising a substantially rectangular sheet of pliable material, a pair of cut-out sections for placement therethrough of the feet of said golfer with the feet resting on the ground, a plurality of parallely disposed separate length and axis indicating straightline markings on said mat substantially perpendicular to the intended line of flight of a golf ball hit by said golfer, each of said markings corresponding to at least one particular golf club type and having an outer end even with the outer end of each other marking, and each of said markings having a length substantially equal to the distance of placement of the golf ball from the outer end of said marking in alignment therewith and outside of the periphery of said rectangular sheet.

2. The mat of claim 1 further comprising a marking designating the axis and direction of flight of said ball.

3. The mat of claim 1 wherein each of said markings is in the form of a strip affixed to the top surface of said mat.

4. The mat of claim 3 wherein each of said strips has a centerline in the form of a groove for proper alignment of said ball.

5. The mat of claim 4 wherein the longest of said strips bears indicia indicating its intended use in conjunction with a driver club, said strip being disposed 4 inches from a reference line tangent to the outer edge of the perimeter of the foot cut-out portion situated towards the direction of flight of said ball, a second strip shorter than said first strip is disposed 5½ inches from said reference line and is designated for #3, #4 and #5 woods with appropriate length indicia for placement of the ball, a third strip designated for #2, #2, and #4 irons with corresponding appropriate length indicia markings for placement of the ball is disposed 7½ inches from said reference line, and a fourth strip with appropriate length indicia markings for placement of the ball corresponding to #5, #6, #7 #8 and #9 irons is disposed 9½ inches from said reference line.

6. The mat of claim 1 wherein said pliable material is a sheet of rubber-like material.

7. The mat of claim 1 wherein said pliable material is a sheet of plastic.

* * * * *

UNITED STATES PATENT AND TRADEMARK OFFICE

CERTIFICATE OF CORRECTION

PATENT NO. : 4,101,130
DATED : July 18, 1978
INVENTOR(S) : Earl Richards

It is certified that error appears in the above-identified patent and that said Letters Patent are hereby corrected as shown below:

Column 2, line 47, delete "190", and insert thereinstead --#--.

Column 4, line 43, delete "#2" (second occurrence) and insert thereinstead --#3--.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*